US011219315B1

(12) United States Patent
Marshall

(10) Patent No.: US 11,219,315 B1
(45) Date of Patent: Jan. 11, 2022

(54) BEAUTIFICATION PRACTITIONER'S CHAIR

(71) Applicant: Savanna Marshall, Inglewood, CA (US)

(72) Inventor: Savanna Marshall, Inglewood, CA (US)

( * ) Notice: Subject to any disclaimer, the term of this patent is extended or adjusted under 35 U.S.C. 154(b) by 0 days.

(21) Appl. No.: 17/469,336

(22) Filed: Sep. 8, 2021

(51) Int. Cl.

| | |
|---|---|
| ***A47C 1/04*** | (2006.01) |
| ***A47C 1/11*** | (2006.01) |
| ***A47C 1/10*** | (2006.01) |
| ***A47C 7/62*** | (2006.01) |
| ***A47C 1/035*** | (2006.01) |
| ***A47C 1/06*** | (2006.01) |

(52) U.S. Cl.
CPC ..... *A47C 1/04* (2013.01); *A47C 1/035* (2013.01); *A47C 1/06* (2013.01); *A47C 1/10* (2013.01); *A47C 1/11* (2013.01); *A47C 7/624* (2018.08); *A47C 7/626* (2018.08)

(58) Field of Classification Search
CPC .... A47C 1/04; A47C 1/06; A47C 1/10; A47C 1/11035; A47C 7/624; A47C 7/626
USPC ..... 297/188.17
See application file for complete search history.

(56) References Cited

U.S. PATENT DOCUMENTS 2,229,937 A * 1/1941 Reese ..... A47C 7/624 312/235.6
2,502,383 A * 3/1950 Osofsky ..... A47C 7/624 297/145
2,547,547 A * 4/1951 Tatar ..... A47C 7/624 312/235.6
3,136,578 A * 6/1964 Tihovici ..... A47C 7/624 297/188.16
5,106,153 A * 4/1992 Durling ..... A47C 7/68 297/232

(Continued)

FOREIGN PATENT DOCUMENTS

FR 837120 A * 2/1939 ..... A47C 1/04
WO WO-2017085654 A1 * 5/2017 ..... A47C 1/06

OTHER PUBLICATIONS

Callan Furniture, Owner's Box Power Reclining Loveseat with Console by Signature Design by Ashley, https://www.callanfurniture.com/shop-living-room-furniture/loveseats/signature-design-by-ashley-new-2450518-owner-s-box-power-reclining-loveseat-with-console.html, accessed Sept. 8, 2021.

(Continued)

*Primary Examiner* — Robert Canfield
(74) *Attorney, Agent, or Firm* — Trojan Law Offices

(57) ABSTRACT

This invention is directed to a beautification practitioner's chair capable of reclining to a substantially horizontal position and having integrated storage that may include rearwardly sliding trays and/or drawers. The beautification practitioner's chair may include a seat, a seat back, at least one arm rest, a head rest, and a leg rest. Contained below the at least one arm rest is at least one compartment that is generally enclosed on its front, sides, top, and bottom, and is generally accessible through the rear of the compartment. Contained therein may be at least one tray, at least one drawer, and/or at least one storage container. The compartment is configured to provide integrated storage in the beautification practitioner's chair, and the beautification practitioner's chair is configured such that the seat back is capable of reclining to a substantially horizontal position.

20 Claims, 6 Drawing Sheets

(56) References Cited

U.S. PATENT DOCUMENTS

| | | | | |
|---|---|---|---|---|
| 5,359,737 | A * | 11/1994 | Hodge | A47K 11/04 4/476 |
| 6,568,008 | B2 | 5/2003 | Siepmann et al. | |
| 7,416,235 | B2 | 8/2008 | Rajappa et al. | |
| 8,096,006 | B2 | 1/2012 | DeBraal et al. | |
| 2009/0152915 | A1* | 6/2009 | Krasna | A47C 7/727 297/217.3 |
| 2017/0258235 | A1* | 9/2017 | Hassman | G07F 9/105 |
| 2017/0295934 | A1* | 10/2017 | Fisher | A47C 1/035 |

OTHER PUBLICATIONS vitalitymedical.com, Lumex Deluxe Clinical Care Geri Chair Recliner with Tray, https://www.vitalitymedical.com/lumex-deluxe-clinical-care-geri-chair-recliner-with-tray.html, accessed Sept. 8, 2021.

* cited by examiner

BEAUTIFICATION PRACTITIONER'S CHAIR

FIELD OF THE INVENTION

The present invention relates generally to a beautification practitioner's chair to be used by beautification practitioners capable of reclining to a horizontal position and including integrated storage which may include at least one drawer and/or at least one tray.

BACKGROUND OF THE INVENTION

Beautification practitioners are people who specialize in beautifying their clients. Beautification practitioners include anyone who provides the service of beautifying their clients. For example, beautification practitioners include estheticians, lash artists, tattoo artists, body piercers, cosmetologists, permanent make-up artists, body painters, or medical professionals such as doctors who provide medical procedures for beautification. The list provided above is non-exhaustive, as any person who provides the service of beautifying their clients are beautification practitioners as defined herein.

In performing this work, beautification practitioners generally need easy access to a client's skin in order to perform their services. However, many chairs used by beautification practitioners have significant drawbacks to both the client and beautification practitioner. For example, some beautification practitioners use general salon chairs. These general salon chairs may be uncomfortable for clients. For example, if the service provided requires a long period of time to perform, such as a tattoo, the client may be uncomfortable sitting for a long period of time while the beautification practitioner performs their service. Additionally, it may be difficult for the beautification practitioners to perform some of their services if the client is in a seated position.

Some beautification practitioners may use recliner chairs instead of salon chairs so that the beautification practitioner may easily access client's skin and facial features, while allowing the client to comfortably lay down flat on their back. However, due to the size of these recliner chairs, it is nearly impossible to keep the beautification practitioner's tools and other items needed for their services readily accessible. For example, should a beautification practitioner use a general recliner chair, the beautification practitioner's tools and storage for other items is generally on a separate table or in a separate cabinet. Thus, in order for the beautification practitioner to perform their services, the beautification practitioner would need to continuously get up and move in order to change tools or grab any other required items, thereby causing a large loss in efficiency in performing their services. As beautification practitioners generally perform services by appointment, any loss in efficiency such as this results in less clients seen, which results in less money the beautification practitioners can bring in.

As such, there is a need for a beautification practitioner's chair that allows a client to comfortably sit and/or lay down depending on the service needed. Additionally, there is a need for a beautification practitioner's chair that provides an integrated storage system which may have integrated drawers and/or trays, such that the beautification practitioner does not have to continuously move about the studio to change tools. Therefore, there is a need for a beautification practitioner's chair that is capable of reclining to a substantially horizontal position that also includes an integrated storage system that may have a tray and/or drawers that are easily accessible for beautification practitioners.

SUMMARY OF THE INVENTION

The present invention is generally directed to a beautification practitioner's chair having integrated storage and capable of reclining to a substantially horizontal position. The beautification practitioner's chair generally includes a seat, a seat back, and at least one arm rest. The beautification practitioner's chair may further include a leg rest and a head rest. Contained below the at least one arm rest is at least one compartment. The compartment is generally enclosed on its front, sides, top, and bottom, and is generally accessible through the rear of the compartment. Contained in the compartment may be at least one tray, at least one drawer, and/or at least one storage container. The compartment is configured to provide integrated storage in the beautification practitioner's chair. The beautification practitioner's chair is configured such that the seat back is capable of reclining to a substantially horizontal position, such that the seat, the seat back, and if applicable the leg rest are in a substantially horizontal position.

BRIEF DESCRIPTION OF THE DRAWINGS

These and other features and advantages of the present invention will become appreciated, as the same becomes better understood with reference to the specification, claims and drawings herein:

DETAILED DESCRIPTION OF THE INVENTION

Figure 1:
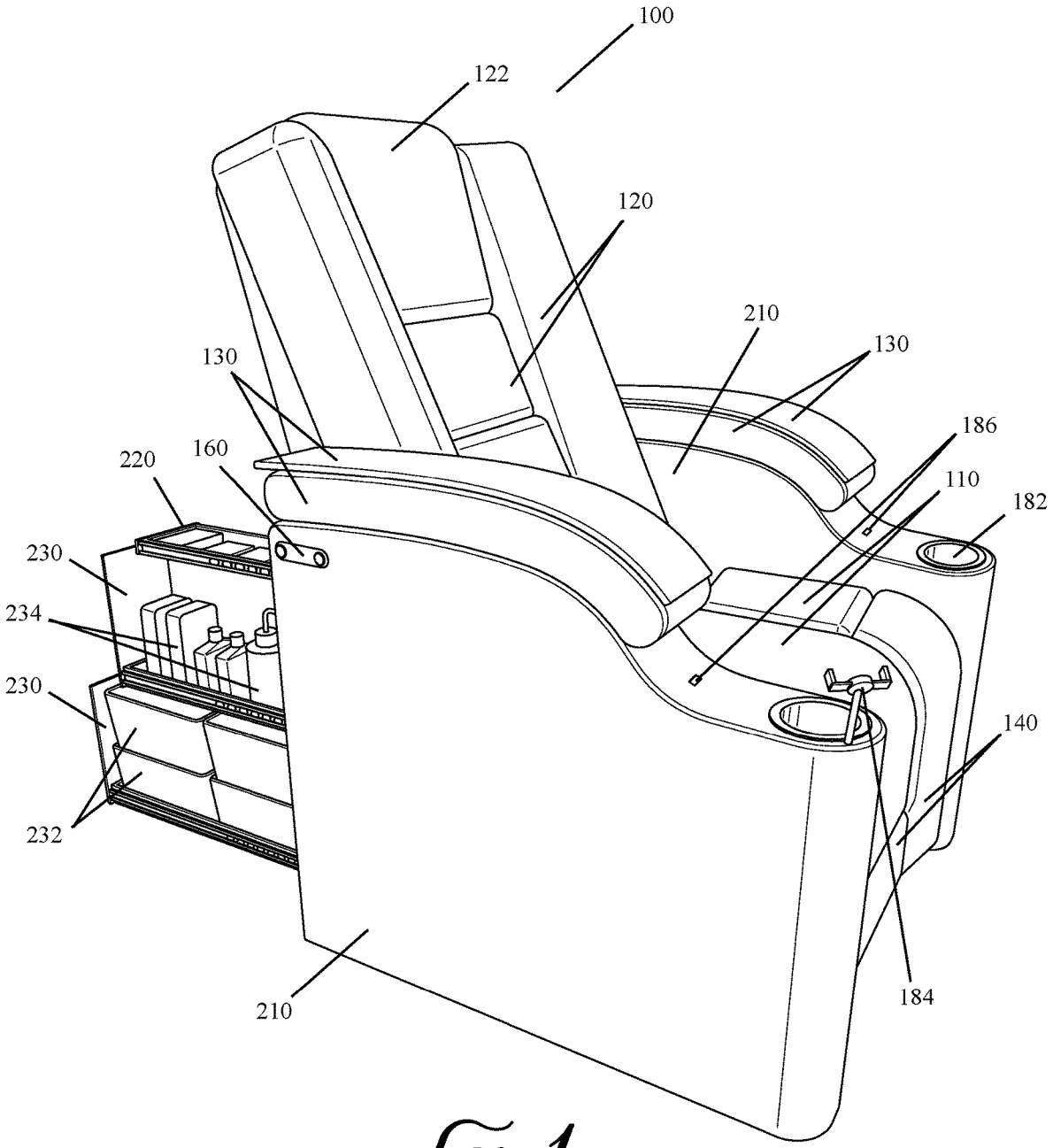
FIG. 1 is a front perspective view of a beautification practitioner's chair in a first position in accordance with an embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present there between. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

As used herein, the singular forms "a," "an," and "the," are intended to include the plural forms as well, unless the context clearly indicates otherwise. It will be further understood that the terms "comprises" and/or "comprising," "includes" and/or "including," and "have" and/or "having," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," and "upper" or "top," and "inner" or "outer," may be used herein to describe one element's relationship to another elements as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

Depicted by FIGS. 1-6, the present invention is generally directed to an beautification practitioner's chair, having integrated storage and capable of reclining to a substantially horizontal position. As shown in FIG. 1, the beautification practitioner's chair 100 generally includes a seat 110, a seat back 120, and at least one arm rest 130. Additionally, the beautification practitioner's chair 100 may further include a leg rest 140 and a head rest 122. Contained below the at least one arm rest 130 is at least one compartment 210. The compartment 210 is generally enclosed on its front, each side, top, and bottom. The compartment 210 is generally accessible through the rear of the compartment 210. Contained in the compartment 210 may be at least one tray 220, at least one drawer 230, and/or at least one storage container 232. As such, the compartment 210 is configured to provide integrated storage in the beautification practitioner's chair 100. The beautification practitioner's chair 100 is also configured such that the seat back 120 is capable of reclining to a substantially horizontal position, such that the seat 110, the seat back 120, and if applicable the leg rest 140 are substantially parallel with the floor the beautification practitioner's chair 100 is placed on.

A beautification practitioner using the beautification practitioner's chair 100 may recline the seat back 120 such that a client seated in the beautification practitioner's chair 100 may be positioned in a laid-down position. This position allows the beautification practitioner to easily access the client's face and skin from a seated position. Due to the unique configuration of the at least one compartment 210 below the at least one arm rest 130, the integrated storage allows the beautification practitioner to store and easily access any beautification practitioner's tools 234 and any other items a beautification practitioner may need to beautify the client.

An exemplary embodiment of the beautification practitioner's chair 100 is provided in FIGS. 1-6. FIG. 1 depicts the beautification practitioner's chair 100 in a first position and having the compartment 210 in an open position. As shown in FIG. 1, the beautification practitioner's chair 100 includes a seat 110, a seat back 120, a head rest 122, a leg rest 140, and at least one arm rest 130. In this exemplary embodiment, the beautification practitioner's chair 100 has two arm rests 130, one on each side of the seat 110. While the exemplary embodiment depicts two arm rests 130, any number of arm rests 130 may be utilized without departing from the concepts disclosed herein.

Located under the at least one arm rest 130 is at least one compartment 210. While any number of compartments 210 may be used without departing from the concepts disclosed herein, the exemplary embodiment shown in FIG. 1 has two compartments 210, one located under each arm rest 130. The compartments 210 are enclosed on their front, sides, top, and bottom, and is generally accessible through the rear of the compartment 210.

Inside the compartments 210 may be at least one tray 220, at least one drawer 230, and/or at least one storage container 232. In the exemplary embodiment shown in FIG. 1, each of the compartments 210 include a tray 220 and two drawers 230 located below the tray 220. Located in the drawers 230 may be the beautification practitioner's tools 234 and/or the storage containers 232. While the exemplary embodiment provides for two drawers 230 and one tray 220 in each compartment 210, any number of trays, drawers, and/or storage containers may be contained within the compartment 210 without departing from the concepts disclosed herein. In some other embodiments, the compartment may not contain trays or drawers, instead only containing an open space for storing items. In some other embodiments, a combination of general storage and trays and/or drawers may be utilized without departing from the concepts disclosed herein. Access to the trays 220, drawers 230, and any items inside the compartment 210 is through the rear of the compartment 210.

The trays 220, drawers 230, and/or storage containers 232 may be configured such that the beautification practitioner's tools 234 are easy to place in the trays 220, drawers 230, and/or storage containers 232, and are easily accessible once the compartment 210 is in its open position. In one example, if the beautification practitioner is an esthetician, the trays 220, drawers 230, and/or storage containers 232 may be configured such that tools used by an esthetician, such as tweezers and exfoliating brushes, may be easily placed in the trays 220, drawers 230, and/or storage containers 232 and easily accessed by the esthetician. In another example, if the beautification practitioner is a tattoo artist, the trays 220, drawers 230, and/or storage containers 232 may be configured such that tools used by a tattoo artist, such as a tattoo gun, needles and ink may also be easily placed in the trays 220, drawers 230, and/or storage containers 232 and easily accessed by the tattoo artist. In some embodiments where the beautification practitioner's tools 234 require a power source, such as a tattoo gun, the beautification practitioner's chair 100 may be further configured to include a power source and/or power outlet.

The head rest 122 shown in this exemplary embodiment is part of the seat back 120, such that the seat back 120 includes a head rest 122. In some embodiments, the head rest 122 has a mechanism configured to allow the head rest 122 to be raised or lowered in relation to the top of the seat back 120. In other embodiments, the head rest 122 may be separate from the seat back 120. Further, the head rest 122 may be fixed in place above the seat back 120, or alternatively may be fixed within the seat back 120 at a fixed position.

Additional accessories for the beautification practitioner's chair 100 may further be included without departing from the concepts disclosed herein. In the exemplary embodiment shown in FIG. 1, the beautification practitioner's chair 100 further includes at least one cup holder 182, at least one mobile phone mount 184, and at least USB port 186. These accessories may be placed in different locations on the beautification practitioner's chair 100 but are preferably located on the compartment 210 such that any additional space needed for the accessory may be stored in the compartment 210. For example, in the exemplary embodiment depicted in FIG. 1, the controller and power source for the USB port 186 are stored inside the compartment 210 and may be accessed through the rear of the compartment 210.

Figure 2:
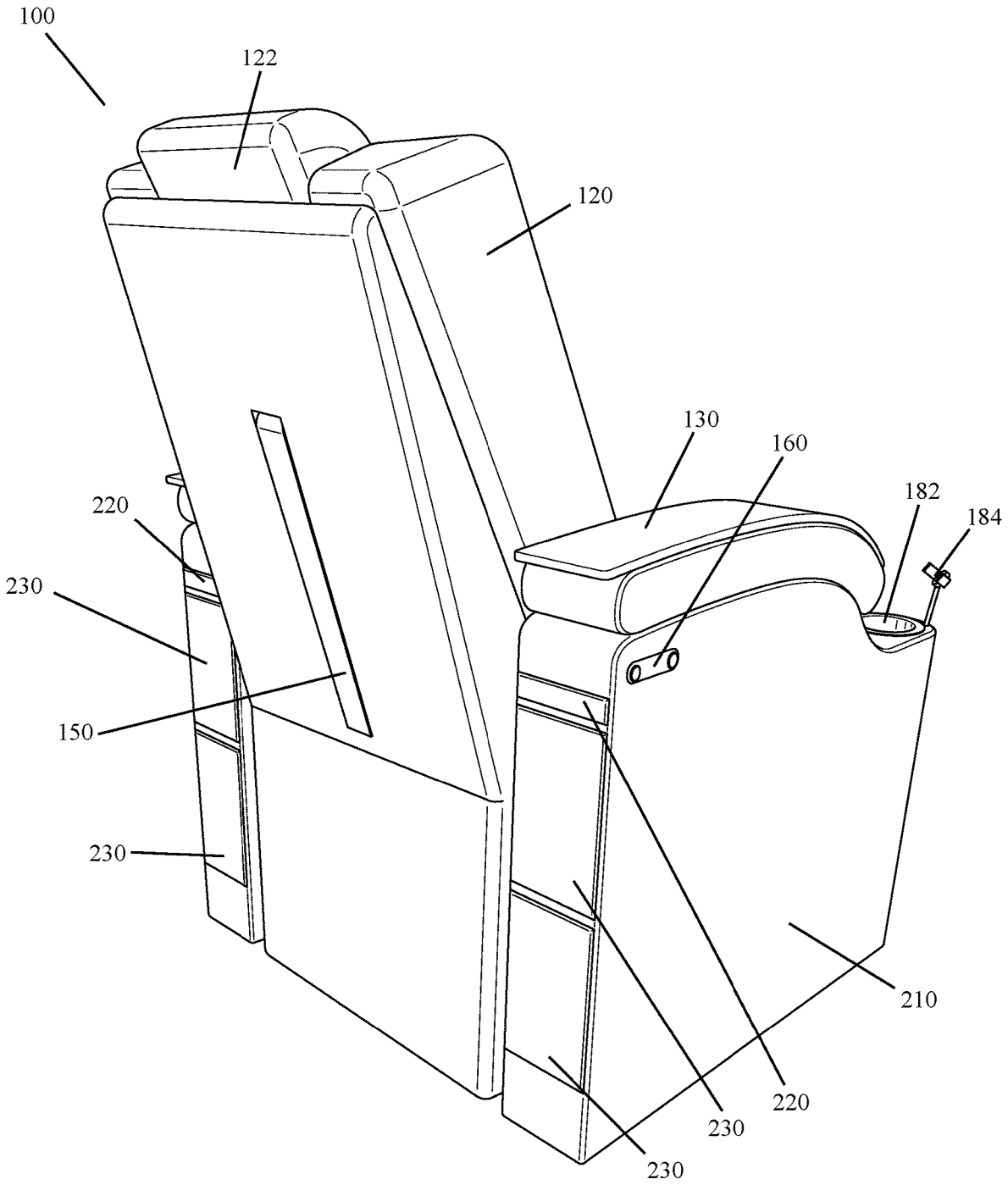
FIG. 2 is a rear perspective view of the beautification practitioner's chair of FIG. 1 in a first position.
Figure 3:
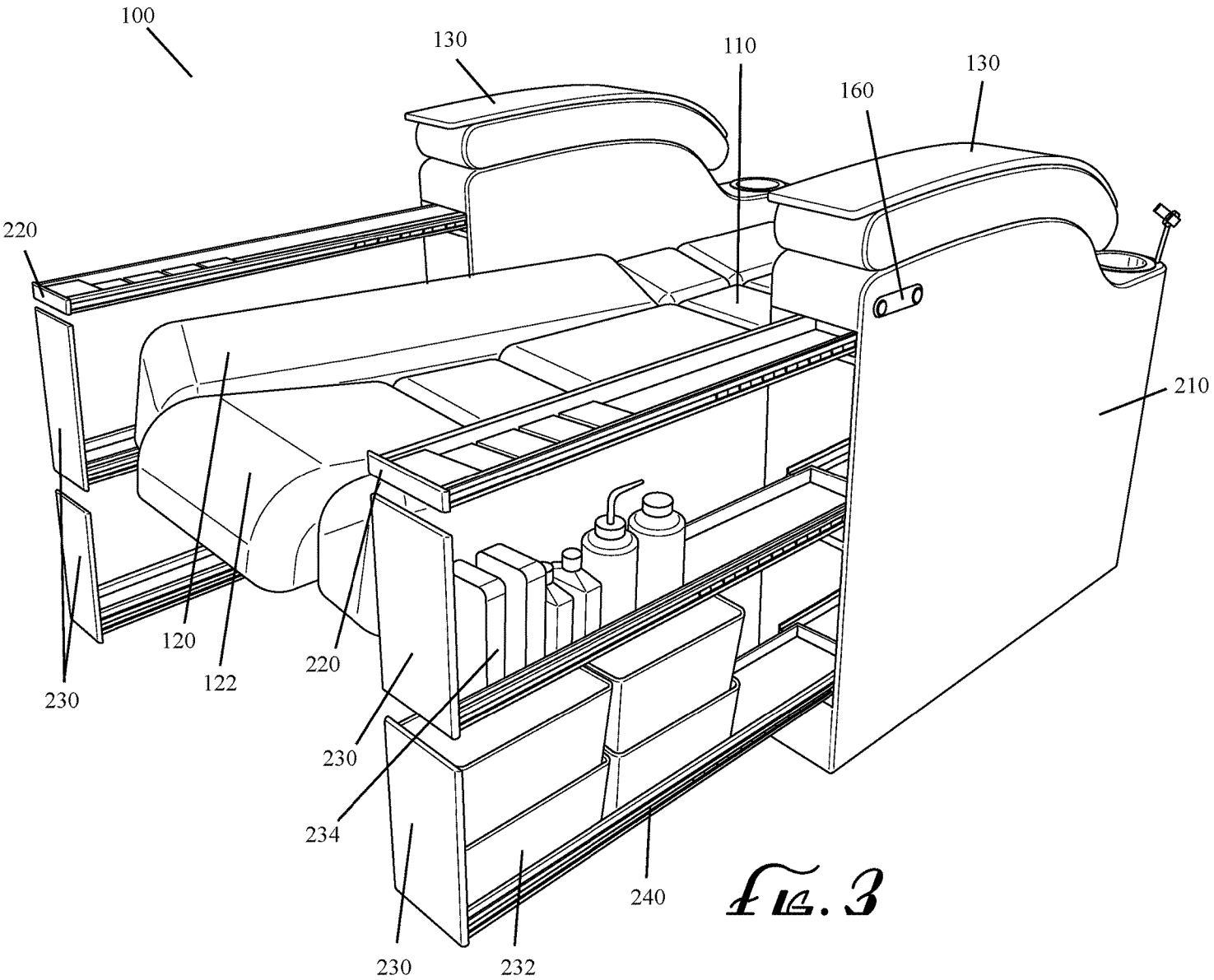
FIG. 3 is a rear perspective view of the beautification practitioner's chair of FIG. 1 in a second position.

FIGS. 2-3 depict the beautification practitioner's chair 100 in a first position and second position. The first position shown in FIG. 2 is configured such that the seat back 120 is near a 90-degree angle in relation to the seat 110. In this position, a client may be seated in the beautification practitioner's chair 100 with their back resting against the seat back 120. In the exemplary embodiment showing a leg rest 140, the leg rest 140 is configured to raise to be in a substantially vertical position in relation to the seat 110 and located at the opposite end of the seat 110 compared to the seat back 120, thereby forming the general chair shape of the beautification practitioner's chair 100.

The second position shown in FIG. 3 is configured such that the seat back 120 is reclined to a substantially horizontal position in relation to the seat 110. In this exemplary embodiment including a leg rest 140, the leg rest 140 is configured to raise to a substantially horizontal position in relation to the seat 110 as well, thereby forming a substantially flat horizontal surface. In this position, a client may lay in the beautification practitioner's chair 100 with their back laying against the substantially horizontal seat back 120 such that the client is in a laid-down position. Further, if needed for the services rendered by the beautification practitioner, a client may also lay in the beautification practitioner's chair 100 with their front laying against the substantially horizontal seat back 120 such that the client is in a laid-down position with their back facing upward. This specific position may be especially applicable for tattoo artists who may be tattooing the back of a client.

A support bar 150 may be included that is configured to provide additional support to the rear of the seat back 120 when the beautification practitioner's chair 100 is in the second position. When in the first position, the support bar 150 may be positioned in the rear of the seat back 120 such that it is flush with the rear of the seat back 120. When in the second position, the support bar 150 is configured to extend down from the seat back 120 to the ground level, thereby providing additional support to the seat back 120 when in a horizontal position.

As shown in FIGS. 2-3, the beautification practitioner's chair 100 is capable of moving between the first position and the second position. Included in the beautification practitioner's chair 100 is a means for moving the beautification practitioner's chair 100 between the first position and second position. The means for moving the beautification practitioner's chair 100 is configured to allow the seat back 120 to recline from the first position shown in FIG. 1 to the second position shown in FIG. 2, then return from the second position to the first position. In the exemplary embodiment, the beautification practitioner's chair 100 may be moved to and fixed at any position in between the first position and the second position. In this configuration, the seat back 120 may be reclined to any position between the first position and second position and fixed in that position until either further reclined or raised. In other embodiments, the beautification practitioner's chair 100 may be configured to be fixed at specific positions in between and including the first position and second position.

The support bar 150 may be automatically connected to the means for moving the beautification practitioner's chair 100, such that when the beautification practitioner's chair 100 is reclined to the second position, the support bar 150 is simultaneously and automatically extended downward to the ground. Once the beautification practitioner's chair 100 is returned to the first position, the support bar 150 will simultaneously and automatically return to back of the seat back 120 of the beautification practitioner's chair 100. In other embodiments, the support bar 150 may be manually actuated, such that the support bar 150 is physically moved by the beautification practitioner or other user prior to reclining the beautification practitioner's chair 100.

The means for moving the beautification practitioner's chair 100 may be controlled by a recliner controller 160. In the exemplary embodiment, the recliner controller 160 includes two buttons, one button for reclining the beautification practitioner's chair 100 from the first position to the second position, and the other button for returning the beautification practitioner's chair 100 to the first position from the second position. In the exemplary embodiment, the beautification practitioner's chair 100 will recline or raise so long as the respective button on the recliner controller 160 is held down. With this configuration, releasing the button will stop the beautification practitioner's chair 100 from reclining or raising, thereby fixing the beautification practitioner's chair 100 at its respective position. In other embodiments, a single button and/or single button press may be used to move the beautification practitioner's chair 100 from the first position to the second position and vice versa. In other embodiments, the recliner controller 160 may include more than two buttons, with each button corresponding to a specific position of the beautification practitioner's chair 100 in between the first position and second position. Other configurations may similarly be utilized without departing from the concepts disclosed herein.

FIGS. 2-3 further depict the compartment 210 of the beautification practitioner's chair 100 in the open position and in the closed position. In this closed position shown in FIG. 2, the compartment 210 is closed on all sides such that the inside of the compartment 210 and any contents inside the compartment 210 are not visible. The rear side of the compartment 210 remains accessible and is configured to be capable of being opened and closed. In the exemplary embodiment depicted by FIG. 2, the rear side of the compartment 210 is accessible through a push-to-open system. In this system, the front of the drawers 230 and trays 220 are flush with the rear of the compartment 210 when in a closed position. Upon pushing the front of the drawers 230 and trays 220, the drawers 230 and trays 220 will release from the compartment and may then be moved in and out via a railing system 240. In other embodiments, the compartment 210 may instead be accessible through any other means of opening and closing the compartment 210, such as a door or pull-to-open system. These other configurations may be utilized in other embodiments where drawers and/or trays are not utilized, or where a combination of general storage and drawers and/or trays are utilized.

In the open position shown in FIG. 3, the compartment is open at the rear side such that the inside of the compartment 210 and any contents are visible and easily accessible. The rear side of the compartment 210 remains capable of being opened and closed. Once in the open position, the beautification practitioner may easily access the contents of the compartment 210, such as the beautification practitioner's tools 234 and storage containers 232.

In the exemplary embodiment shown in FIGS. 2-3, the trays 220 and drawers 230 are slidably mounted within the compartment 210. The trays 220 are configured to be capable of sliding rearwardly from the closed position within the compartment 210 to the open position outside of the compartment 210. The trays 220 are further configured to be capable of sliding forwardly from the open position outside the compartment 210 to the closed position inside of the compartment 210. Further, the drawers 230 are configured to be capable of sliding rearwardly from the closed position within the compartment 210 to the open position outside of the compartment 210. The drawers 230 are further configured to be capable of sliding forwardly from the open position outside the compartment 210 to the closed position inside of the compartment 210. In some embodiments, the trays 220 and drawers 230 may be capable of sliding automatically or manually.

Figure 4:
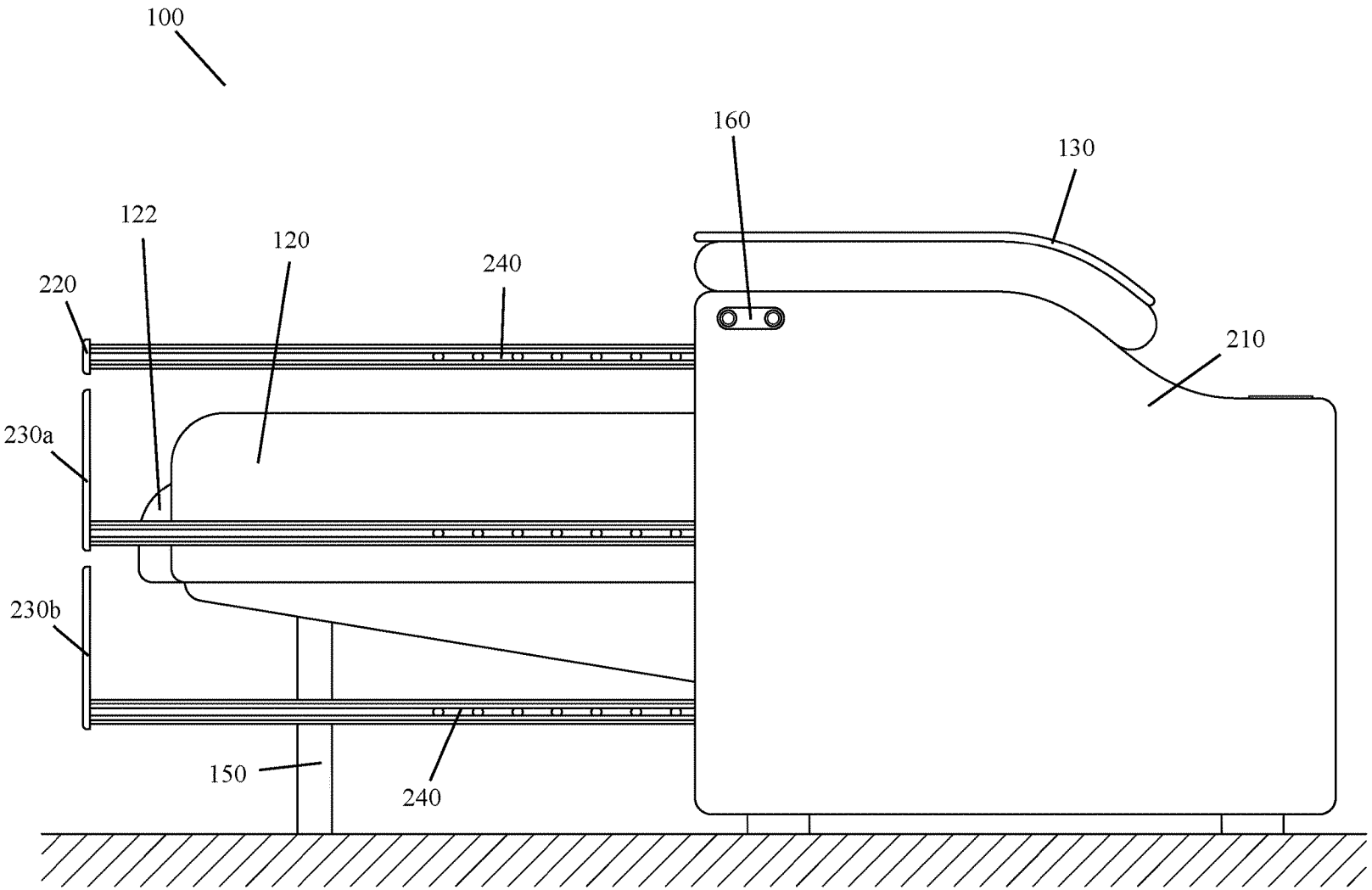
FIG. 4 is a right side view of the beautification practitioner's chair of FIG. 1 in a second position.
Figure 6:
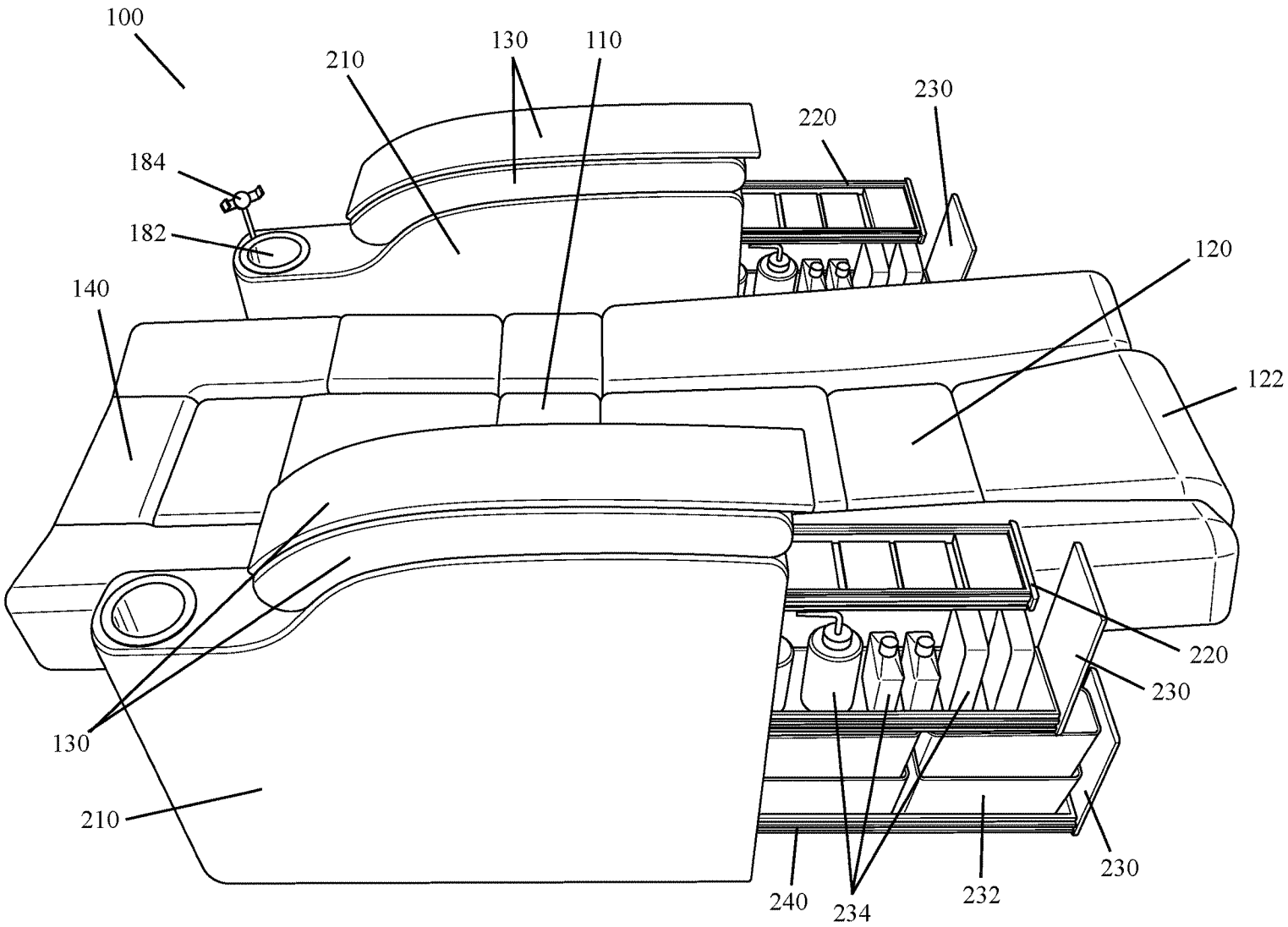
FIG. 6 is a top side perspective view of the beautification practitioner's chair of FIG. 1 in a second position.

As shown in the exemplary embodiment of FIG. 4, the tray 220 and drawers 230 in their open position are in a substantially horizontal position and are substantially parallel with the head rest 122, seat back 120, and arm rests 130. When fully extended to the open position, the tray 220 and the drawers 230 may extend beyond that of the head rest 122. The trays 220 and drawers 230 may be moved to and stopped at any point in between the closed position and fully extended open position, as shown in FIG. 6. Further, in this exemplary embodiment, the tray 220 and drawers 230 are placed in the following order starting from the top: tray 220, top drawer 230*a*, bottom drawer 230*b*. While this configuration is used in the exemplary embodiment, other configurations and orders of trays 220 and/or drawers 230, including configurations with only drawers 230 or only trays 220, may be utilized without departing from the concepts disclosed herein.

Also shown in FIG. 4 is the support bar 150 supporting the seat back 120 when the beautification practitioner's chair 100 is in the substantially horizontal second position. Once the beautification practitioner's chair 100 is fully reclined to the second position such that the seat back 120, seat 110, head rest 122, and leg rest 140 are in the substantially horizontal position, the support bar 150 is configured to contact the ground at a 90-degree angle and provide additional support to the back of the seat back 120.

Figure 5:
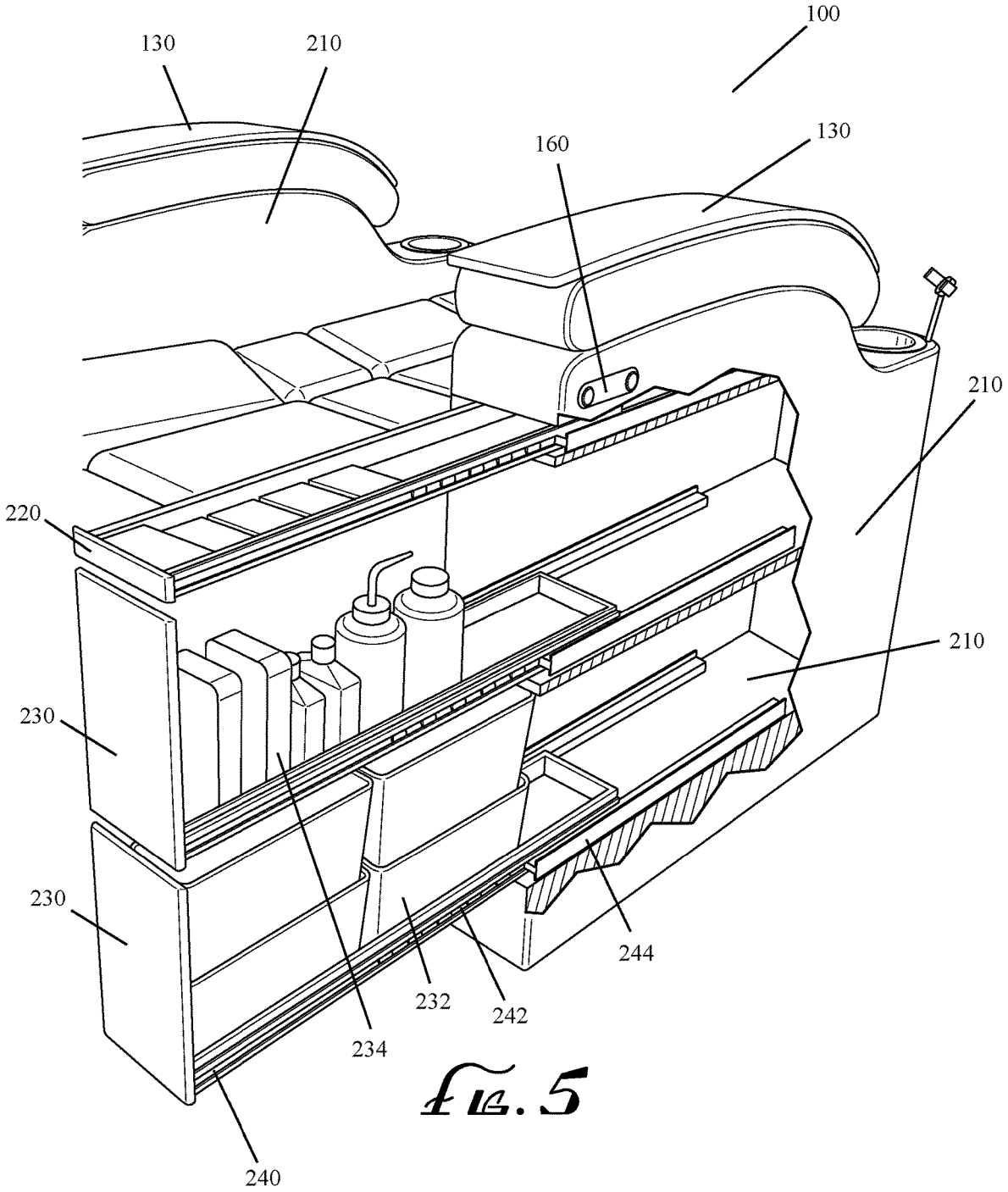
FIG. 5 is a rear perspective view of the beautification practitioner's chair of FIG. 1 in a second position showing the inside of the compartment.

FIG. 5 depicts a perspective view of a cross section of an exemplary embodiment of the compartment 210. As shown in FIG. 5, the trays 220 and drawers 230 are slidably mounted within the compartment 210 via a railing system 240. The railing system 240 permits the trays 220 and drawers 230 to be rearwardly slid from the closed position to the open position depicted in FIG. 5, and forwardly slid from the open position to the closed position. In this exemplary embodiment, rail supports 244 are mounted inside the compartment 210 such that when the rails 242 are mounted on the drawers 230 and trays 220, they permit the sliding movement of the railing system 240 described above. The compartment 210 may include additional space at the front of the compartment 210, such that additional items may also be stored in the compartment 210. For example, the controller and power source for the USB port 186 accessory or a power source for the beautification practitioner's tools 234 may be stored at the front of the compartment beyond the railing system 240. When the compartment 210 is in its closed position, the beautification practitioner's tools 234 and storage containers 232 are fully enclosed in the compartment 210 but are still accessible through the rear of the compartment 210.

FIG. 6 depicts a top side perspective view of the beautification practitioner's chair 100 in its second, substantially horizontal position. As shown, the seat 110, seat back 120, head rest 122, and leg rest 140 are substantially at a 180-degree angle, such that the entire surface is substantially horizontal and flat. As further shown, the trays 220 and drawers 230 may be rearwardly slid to any position in between the closed position and fully extended open position. Forwardly sliding the trays 220 and drawers 230 back into the compartment 210 effectively close the trays 220 and drawers 230.

During use, the client's head is positioned on the head rest 122 proximate to the trays 220 and drawers 230 containing the beautification practitioner's tools 234 and storage containers 232. In this configuration, the beautification practitioner beautifying the client would be positioned proximate to the client's head and the trays 220 and drawers 230, such that while the beautification practitioner is beautifying the skin of the client, any items needed are easily and readily accessible and within an arm's reach, such as the beautification practitioner's tools 234. Further, as the trays 220 and drawers 230 are configured to be capable of sliding to any position between the closed position and fully extended open position, a beautification practitioner may slide the trays 220 and drawers 230 to any position to reach anything stored in the compartment 210, such as the storage containers 232 in the exemplary embodiment.

To illustrate the invention and concepts disclosed herein, a method of using an exemplary embodiment of the beautification practitioner's chair 100 to beautify a client is provided. First, the beautification practitioner places the client into the beautification practitioner's chair 100 in its first position. While the client in in the beautification practitioner's chair 100 in its first position, the client will be seated in the seat 110 with their back resting against the back rest 120, head against the head rest 122, and legs against the leg rest 140. In this position, the client has access to any of the beautification practitioner's chair 100 accessories, such as the cup holder 182, mobile phone mount 184, and USB Ports 186. The beautification practitioner may also perform any beautification needs of the client that require the client to be in a seated position.

Once the beautification practitioner is ready to beautify the skin of the client, the beautification practitioner will recline the beautification practitioner's chair 100 to its second position. To do so, the beautification practitioner will press one of the buttons on the recliner controller 160, thereby moving the beautification practitioner's chair 100 to its second, substantially horizontal position. During this movement, the seat back 120 is reclined towards a substantially horizontal position in relation to the seat 110, while the leg rest 140 is raised towards a substantially horizontal position in relation to the seat 110. Once positioned on the beautification practitioner's chair 100 in its second position, the client may now be lying flat with their head supported by the head rest 122, body supported by the seat back 120 and support bar 150, abdomen supported by the seat 110, and legs supported by the leg rest 140.

Next, the beautification practitioner will open the compartment 210. The beautification practitioner may open the compartment 210 by rearwardly sliding the trays 220 and drawers 230 out of the compartment 210, thereby providing the beautification practitioner easy access to the beautification practitioner's tools 234 and storage containers 232 contained therein. Further, due to the placement of the trays 220 and drawers 230 on the rear of the compartment 210, all of the items needed for the beautification practitioner to beautify the client are within an arm's reach away. The beautification practitioner may then use these items to beautify the client.

Once the beautification practitioner is done beautifying the client, the beautification practitioner may close the trays 220 and drawers 230 by forwardly sliding them into the compartment 210 to their closed position. The beautification practitioner will then move the beautification practitioner's chair 100 back to its first position. To do so, the beautification practitioner will press the other one of the buttons on the recliner controller 160, thereby moving the beautification practitioner's chair 100 back to its first, generally chair-shaped position. The order of these last two steps is immaterial. Further, the beautification practitioner may move the beautification practitioner's chair 100 back to its first position without closing the trays 220 and drawers 230 first. While this method was described in relation to the exemplary embodiment provided in FIGS. 1-6, this method may be utilized with any embodiment of the invention in accordance with the principles and concepts disclosed herein.

I claim:

1. A beautification practitioner's chair comprising:

a seat, a seat back, and at least one arm rest;

at least one compartment contained below said at least one arm rest, wherein said compartment is accessible through the rear of said compartment; and at least one drawer contained in said at least one compartment, wherein said at least one drawer is slidably mounted within said compartment;

wherein said seat back is capable of reclining to a substantially horizontal position in relation to said seat; and wherein said at least one drawer is configured to rearwardly slide from a closed position contained within said compartment to an open position outside said compartment.

2. The beautification practitioner's chair of claim 1, further comprising:

a head rest, wherein said head rest is included in said seat back.

3. The beautification practitioner's chair of claim 2, wherein said head rest is capable of being raised and lowered in relation to said seat back.

4. The beautification practitioner's chair of claim 1, further comprising:

a leg rest, wherein said leg rest is capable of raising to a substantially horizontal position in relation to said seat and said seat back.

5. The beautification practitioner's chair of claim 2, further comprising:

a leg rest, wherein said leg rest is capable of raising to a substantially horizontal position in relation to said seat and said seat back.

6. The beautification practitioner's chair of claim 1, further comprising:

at least one tray contained in said at least one compartment, wherein said at least one tray is slidably mounted within said compartment.

7. The beautification practitioner's chair of claim 6, wherein said at least one tray is placed above said at least one drawer within said compartment.

8. The beautification practitioner's chair of claim 1, further comprising:

a recliner controller, wherein said recliner controller controls said reclining of said seat back.

9. The beautification practitioner's chair of claim 1, further comprising:

a support bar, wherein said support bar is configured to be placed in the rear of said seat back; and wherein said support bar is configured to extend from said rear of said seat back when said seat back reclines such that said support bar contacts the ground and said seat back.

10. The beautification practitioner's chair of claim 1, wherein said at least one drawer is slidably mounted within said compartment via a railing system.

11. An beautification practitioner's chair comprising:

a seat, a seat back having a head rest, and at least one arm rest;

a compartment contained below said at least one arm rest wherein said compartment is enclosed on its front, side and top wherein the rear side of said compartment remains accessible;

said compartment housing at least one tray slidably mounted within said enclosed compartment;

said seat back capable of reclining to a substantially horizontal position; and, said at least one tray capable of sliding rearwardly from a closed position within said compartment to an open position outside of said compartment and substantially parallel with said head rest;

said compartment housing at least one drawer slidably mounted within said enclose compartment below said tray; and, said at least one drawer capable of sliding rearwardly from a closed position within said compartment to an open position outside of said compartment and substantially parallel with said head rest.

12. The beautification practitioner's chair of claim 11, wherein said head rest is capable of being raised and lowered in relation to said seat back.

13. The beautification practitioner's chair of claim 11, further comprising:

a leg rest, wherein said leg rest is capable of raising to a substantially horizontal position in relation to said seat and said seat back.

14. The beautification practitioner's chair of claim 11, further comprising:

a recliner controller, wherein said recliner controller controls said reclining of said seat back.

15. The beautification practitioner's chair of claim 13, further comprising:

a recliner controller, wherein said recliner controller controls said reclining of said seat back and the raising of said leg rest.

16. The beautification practitioner's chair of claim 11, further comprising:

a support bar, wherein said support bar is configured to be placed in the rear of said seat back; and wherein said support bar is configured to extend from said rear of said seat back when said seat back reclines such that said support bar contacts the ground and said seat back.

17. The beautification practitioner's chair of claim 11, wherein said compartment houses one tray and two drawers.

18. The beautification practitioner's chair of claim 11, further comprising:

a storage container, wherein said storage container is removably placed within said at least one drawer.

19. The beautification practitioner's chair of claim 11, wherein said at least one drawer is slidably mounted within said compartment via a railing system.

20. The beautification practitioner's chair of claim 11, wherein said at least one tray is slidably mounted within said compartment via a railing system.

* * * * *